United States Patent [19]

Paasonen et al.

[11] 4,402,557

[45] Sep. 6, 1983

[54] DRILL STEEL CENTRALIZER

[75] Inventors: Hannu I. Paasonen, Nokia; Pekka M. Salmi; Jarmo Heinonen, both of Tampere, all of Finland

[73] Assignee: Oy Tampella AB, Finland

[21] Appl. No.: 296,132

[22] Filed: Aug. 25, 1981

[30] Foreign Application Priority Data

Aug. 26, 1980 [FI] Finland ..... 802669

[51] Int. Cl.[3] ..... F16C 29/10

[52] U.S. Cl. ..... 308/3.9

[58] Field of Search ..... 308/3.9, 3 R, 26, 184 R, 308/184 A; 384/217, 219

[56] References Cited

U.S. PATENT DOCUMENTS 2,365,681 12/1944 Gartin ..... 308/3.9

2,365,684 12/1944 Gartin ..... 308/3.9

4,076,337 2/1978 Childress ..... 308/3.9

*Primary Examiner*—Lenard A. Footland

*Attorney, Agent, or Firm*—Hill, Van Santen, Steadman & Simpson

[57] ABSTRACT

A drill steel centralizer comprising a body having an immovable jaw positioned in stationary relation to the body. A movable jaw and drill steel guide between said jaws that can be opened and closed by means of the movement of the movable jaw. A locking device providing means by which the movable jaw can cause the drill steel guide to be locked and released into the closed and open positions. Thus, the locking device is held in its locked position by an elastic member that is arranged to transmit a force attempting to open the jaw past the elastic member directly to the body.

7 Claims, 6 Drawing Figures

DRILL STEEL CENTRALIZER

This invention relates to a drill steel centralizer comprising a body, a jaw that is stationary in relation to the body, and a movable jaw, between which jaws there is formed a drill steel guide that can be opened and closed by means of the movement of the movable jaw, and a locking device by means of which the movable jaw can be locked and released into the closed and the open position of the drill steel guide.

In a known drill steel centralizer the movable jaw is locked into the closed position of the drill steel guide hole by means of a turnable latch that can be closed by an elastic member. The same is often accomplished by means of a screw or a nut.

In another known drill steel centralizer the jaws consist of hooks that are opposite each other. When these hooks are turned 90° the drill steel guide is opened for removal of the drill steel.

In addition there are known drill steel centralizers in which the drill steel is held in the cup-shaped part of the body by a pin, a screw or a spring pin. Swedish Pat. No. 206435 discloses a solution according to which a U-shaped guide cup is turned by a pin 180° inside a C-shaped supporting bushing.

The function of the above-mentioned drill steel centralizer designs in working conditions, however, is not satisfactory. The centralizer is continuously exposed to stone dust, mud, blows and heavy vibration, which all cause strong wear of the moving parts of the centralizer. Thereby parts with loose contact wear rapidly, the small clearances for adjustment and the retaining knobs disappear, and the centralizer opens unintentionally. In those centralizers in which the guide hooks are turned 90° the problem of tightening and wear is big, and in addition to that the said construction is complicated and expensive. For centralizers in which a pin or a screw is used for locking, a tool is needed to open the centralizer. The centralizer according to the said Swedish Pat. No. 206435 is especially likely to get stopped and to wear due to stone dust.

The object of the invention is to accomplish a drill steel centralizer of the type mentioned in the beginning, in which centralizer the problems associated with the known centralizers are substantially eliminated.

In order to achieve this object the drill steel centralizer according to the invention is characterized in that the locking device, being held in the locking position by an elastic member, is arranged to transmit the force attempting to open the jaw past the elastic member directly to the body. Thereby the opening force caused by the drill steel on the movable jaw is transferred through the locking device directly to the body without causing an opening force on the locking device.

According to a preferable embodiment of the invention the moving jaw and/or the locking device has a wedge surface, the wedge effect of which limits the movement of the locking device caused by the elastic member and stops the locking device in the locking position. Thus the self-locking wedge angle holds the moving jaw of the drill steel centralizer in the locking position. Thereby the elastic member and the wedge locking keep the centralizer steady even if wear appears on it.

According to another preferable embodiment of the invention the movable jaw is designed and/or placed relative to the locking device so that during the open position of the drill steel guide the jaw prevents the locking device from going over into the locking position, while the locking device, by means of the elastic member, holds the jaw in the open position. Thus the same locking device with the elastic member can be utilized to hold the jaw in the open position.

Three embodiments of the invention will be described in the following in more detail with reference to the accompanying drawings in which FIG. 1A shows a drill steel centralizer according to the first embodiment of the invention in the axial direction of the drill steel; and FIG. 1B shows the same as above, but 90° turned;

Figure 1A:
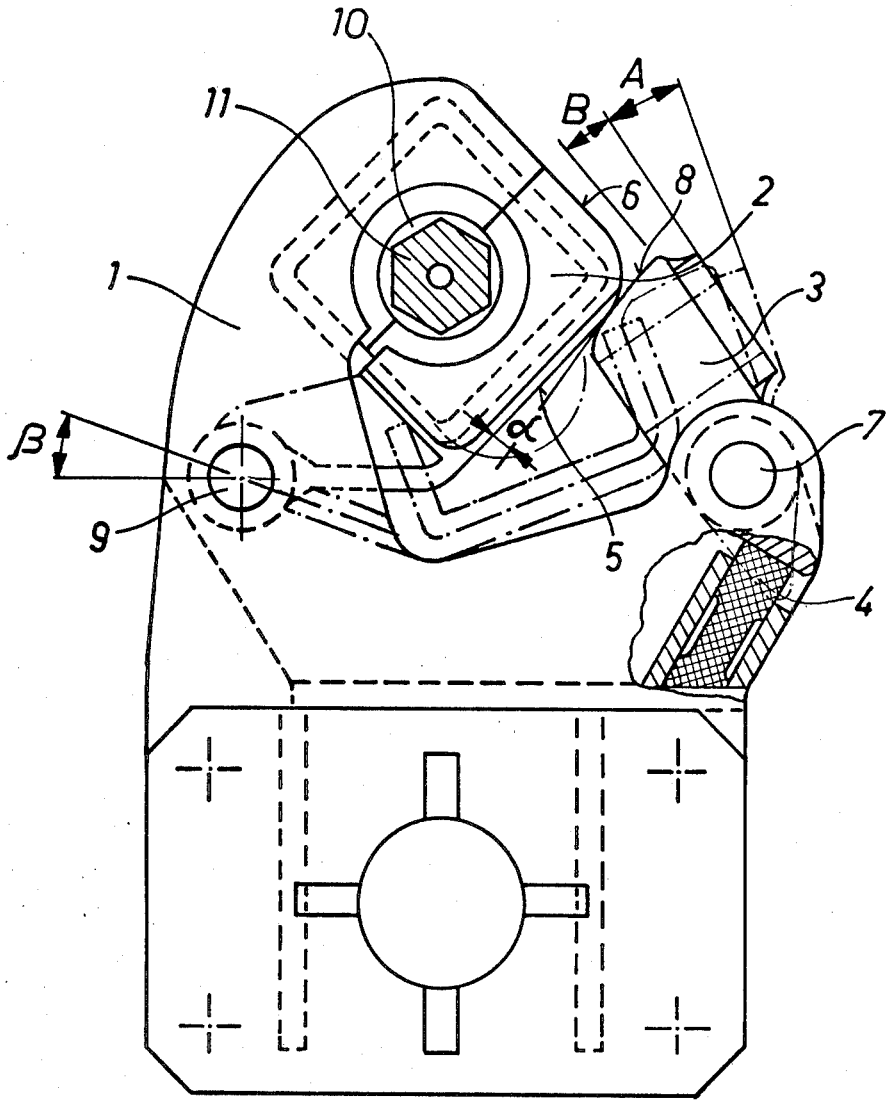

The main parts of a drill steel centralizer according to the invention are a body 1, which also forms a stationary jaw, a movable jaw 2, a locking device 3 and an elastic member 4. In the embodiments according to FIGS. 1 and 2 the locking device 3 is a lever which is turned around an axis 7 by the elastic member 4 so that the surface 8 of the locking device 3 wedges itself against the surface 5 of the movable jaw 2. Thus a small wedge angle $\alpha$ is formed between surfaces 5 and 8, which is self-holding so that no opening force of the jaw 2 can release the locking device 3 from the locking position. Instead, the opening force is transmitted through the turning axis 7 directly into the body 1. The working direction of the elastic member 4 is substantially at right angles to the straight line through the axis 7 and the contact point of the surfaces 5,8 and its sole object is to cause the locking device 3 to wedge itself in the locking position. Reference A shows the movement of the locking device 3 between the opening and locking positions, and reference B shows the additional movement to compensate the gradual wear of the wedge surfaces. Thereby the wear of the movable parts does not loosen the locking as it does in the known solutions. Neither does the danger exist that the locking would open accidentally as it does in some known solutions when the locking latch hits the rock.

In the present case the movable jaw can turn on the axis 9 as allowed by the opening angle $\beta$, whereby the drill steel guide 10 is opened sufficiently for removing and inserting the drill steel 11.

Figure 3A:
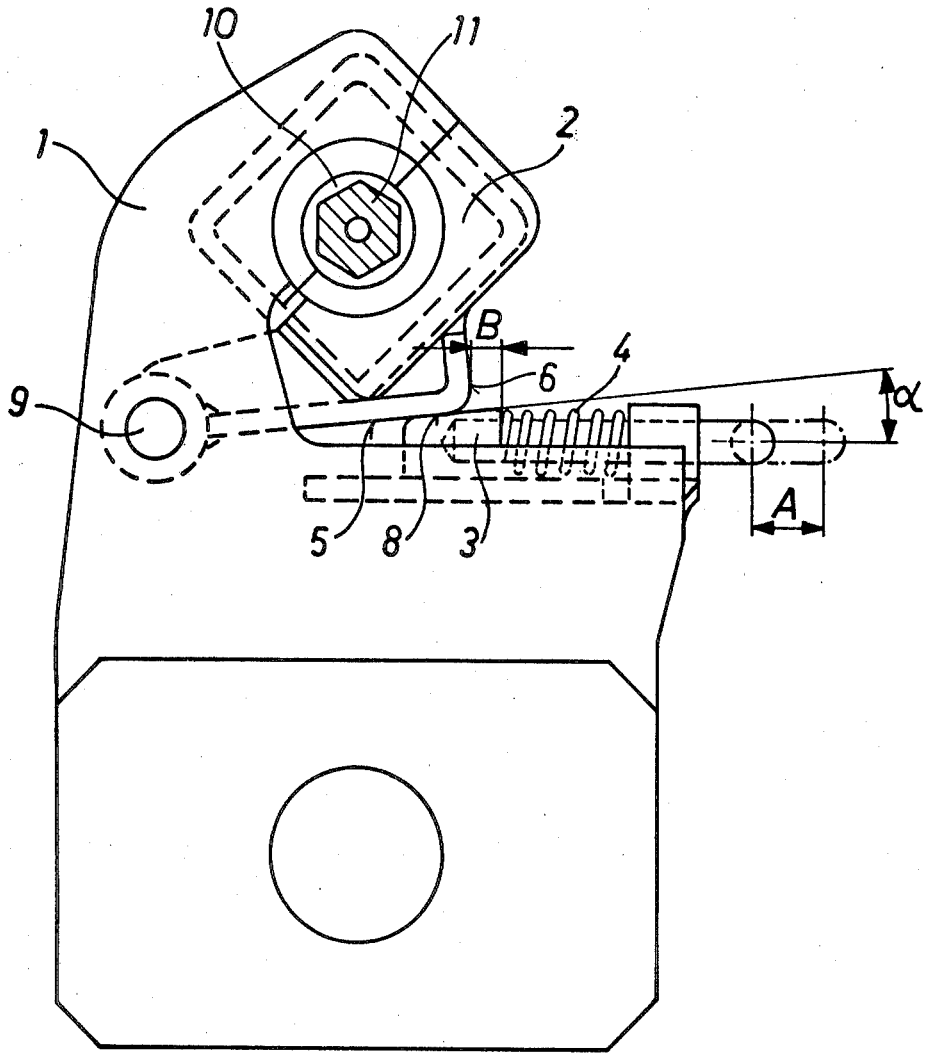
FIGS. 3A and 3B show a drill steel centralizer according to the third embodiment of the invention in the same way as the previous drawings.
Figure 3B:
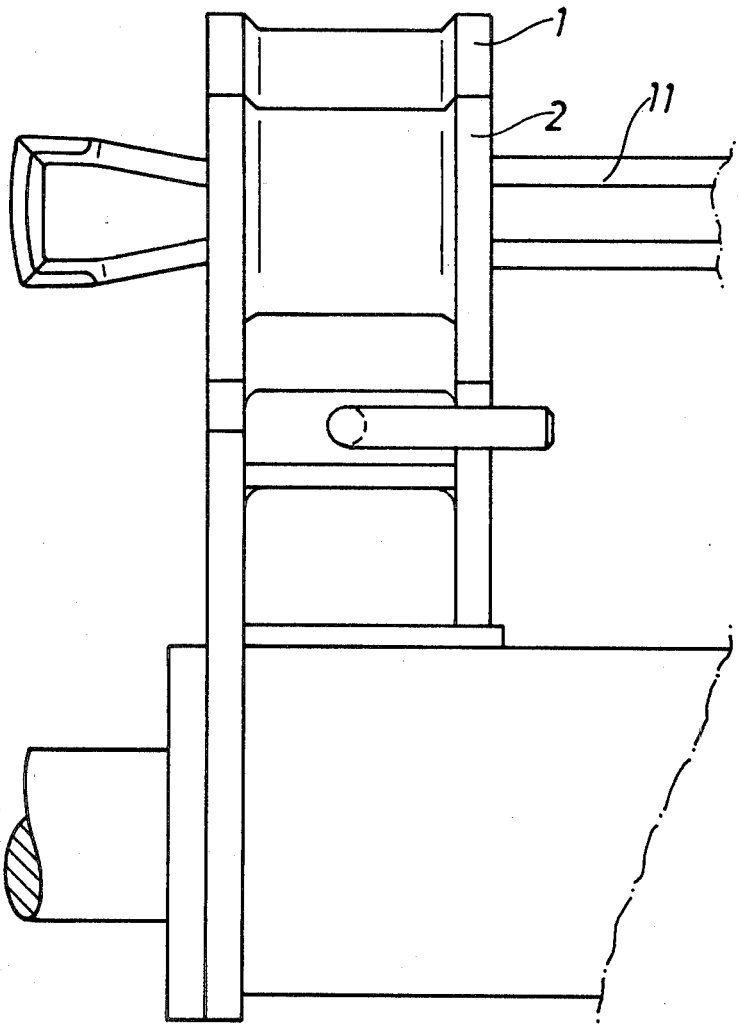

The embodiment according to FIGS. 3A and 3B differs from the foregoing embodiments therein that the locking device 3 is a slide, the movement direction of which forms a small wedge angle with the wedge surface 5 of the movable jaw. The wedge surface 8 of the slide 3 is preferably parallel to the surface 5. The spiral spring 4 pushes the slide 3 into the locking position that is again opened by pulling the slide 3 the length A. Also in this case there is an allowance B to compensate the wear of the wedge surfaces.

In all above-mentioned embodiments, in connection with the movable jaw 2, there is a surface 6 at an angle of about 90° to the wedge surface 5, against which surface 6 the locking device is pushed by the elastic member 4 while the jaw 2 is in the open position. Thus the jaw 2 is held in the open position independently of the position of the drill steel centralizer. When the movable jaw is closed by a force that exceeds its own weight, it is automatically locked into the closed position.

We claim:

1. A drill steel centralizer comprising a body (1), a jaw that is stationary in relation to the body, and a movable jaw (2), between which jaws there remains a drill steel guide (10) that can be opened and closed by means of the movement of the movable jaw (2), and a locking device (3), by means of which the movable jaw (2) can be locked and released into the closed and open positions of the drill steel guide (10), the improvement being that the locking device (3) being held in the locking position by an elastic member (4) is arranged to transmit the force attempting to open the jaw past the elastic member (4), directly to the body (1).

2. A drill steel centralizer according to claim 1, the improvement being that the movable jaw (2) and/or the locking device (3) has a wedge surface (5; 8) which through wedge effect limits the movement of the locking device (3) caused by the elastic member (4) and stops the locking device (3) in the locking position.

3. A drill steel centralizer according to claim 2, the improvement being that the travel of the locking device (3) and the length of the wedge surfaces (5,8) respectively are dimensioned so that if the wedge surfaces are worn, the locking movement (A+B) of the locking device is respectively longer.

4. A drill steel centralizer according to claim 1 or 2, the improvement being that the movable jaw 2 comprises a counter surface (6), which prevents the movement of the locking device (3) into the locking position when the jaw is in the open position of the drill steel guide, while the locking device (3) by means of the elastic member (4) holds the jaw (2) in the open position.

5. A drill steel centralizer according to claim 4, the improvement being that the counter surface (6) of the movable jaw is at an angle of about 90° to the wedge surface (5).

Figure 1B:
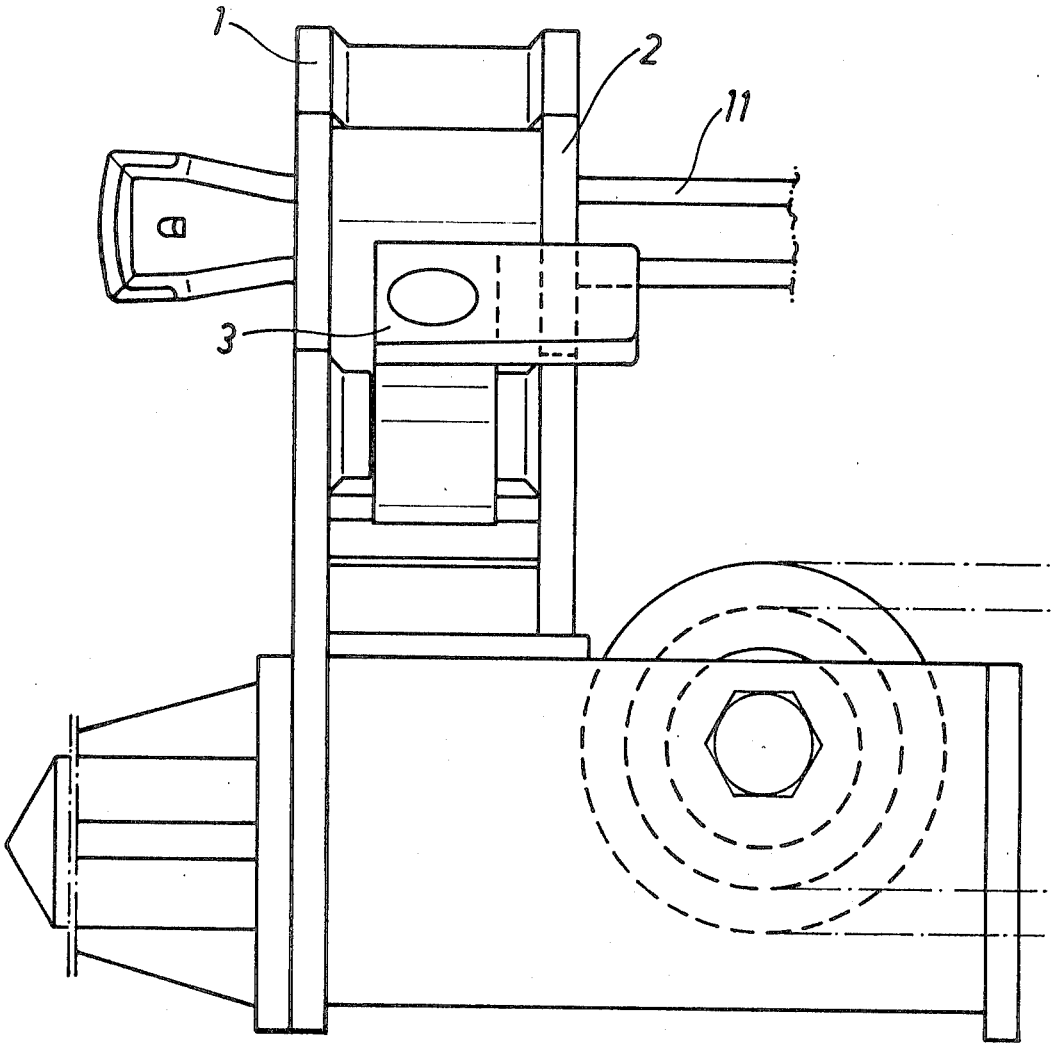
Figure 2A:
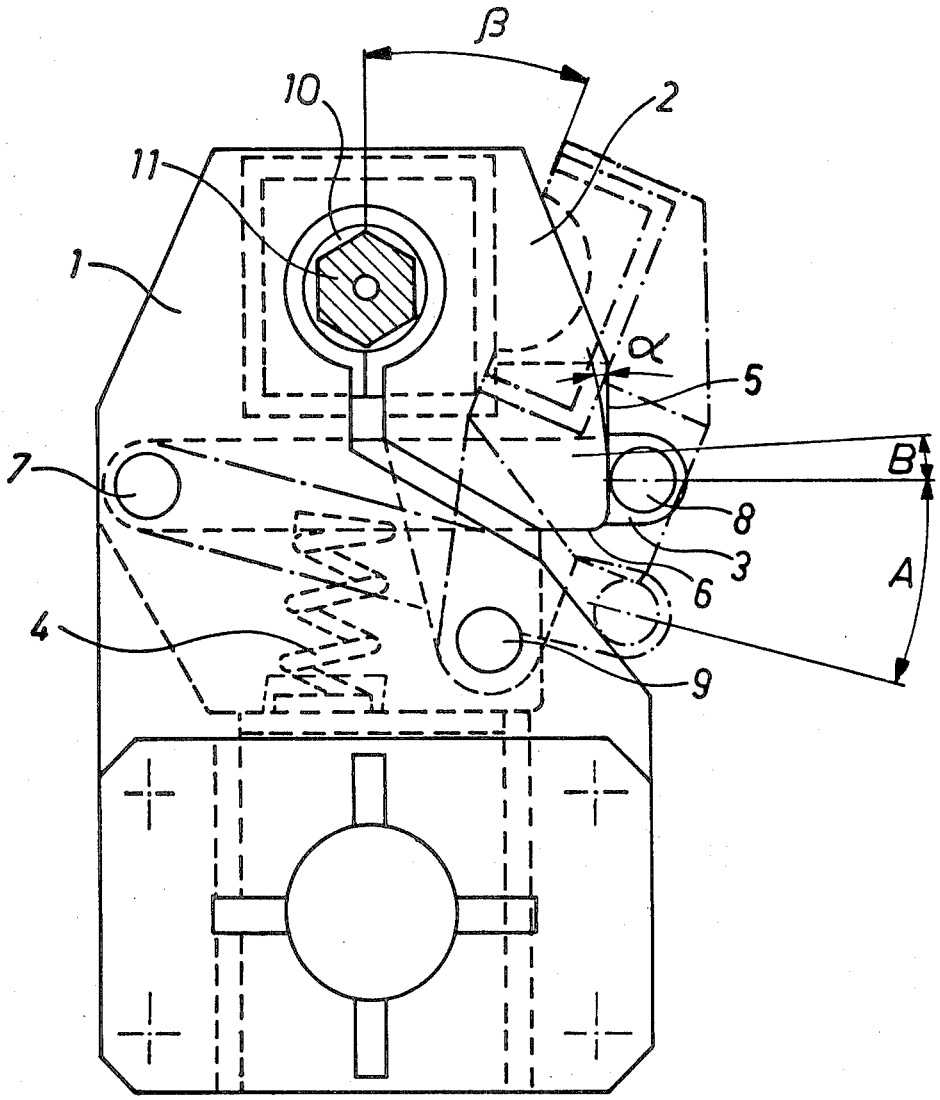
FIGS. 2A and 2B show a drill steel centralizer according to the second embodiment of the invention in the same way as FIGS. 1A and 1B.
Figure 2B:
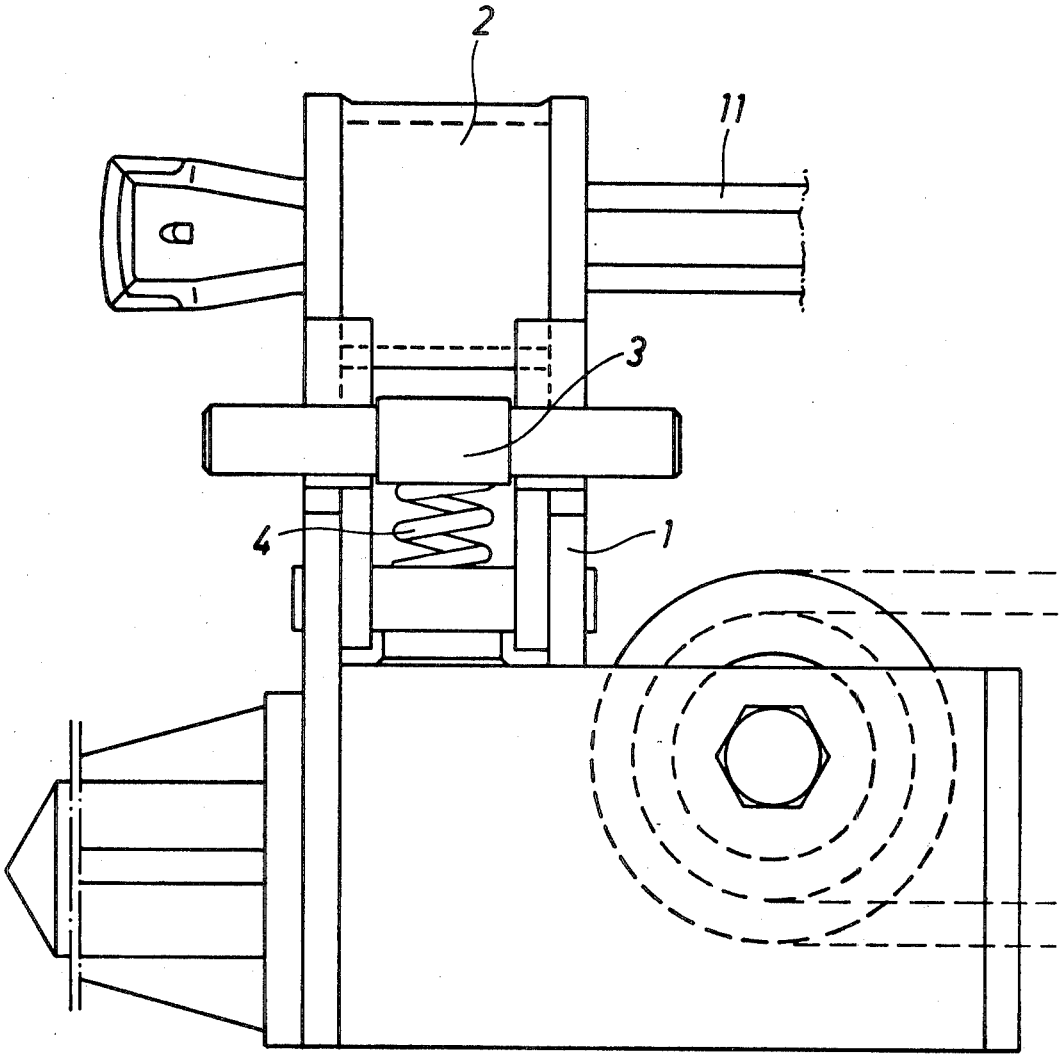

6. A drill steel centralizer according to claim 1, the improvement being that the locking device (3) is a lever that is turnably mounted on the body and is affected by the elastic member (4) in a direction perpendicular to the straight line going through the turning axis (7) of the lever and the contact point of the wedge surfaces (5,8) of the lever and the movable jaw (FIGS. 1 and 2).

7. A drill steel centralizer according to claim 1, the improvement being that the locking device (3) is a slide, the movement direction of which, being the same as the direction of the power of the elastic member (4), forms a small wedge angle ($\alpha$) with the wedge surface (5) of the movable jaw.

* * * * *